US006512487B1

(12) United States Patent
Taylor et al.

(10) Patent No.: US 6,512,487 B1
(45) Date of Patent: Jan. 28, 2003

(54) WIDEBAND PHASED ARRAY ANTENNA AND ASSOCIATED METHODS

(75) Inventors: Robert Charles Taylor, Melbourne, FL (US); Benedikt A. Munk, Columbus, OH (US); Timothy Earl Durham, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 33 days.

(21) Appl. No.: 09/703,247

(22) Filed: Oct. 31, 2000

(51) Int. Cl.[7] ..... H01Q 1/38
(52) U.S. Cl. ..... 343/795; 343/797
(58) Field of Search ..... 343/795, 797, 343/802, 813, 815, 824, 827; H01Q 1/38

(56) References Cited

U.S. PATENT DOCUMENTS 3,016,536 A * 1/1962 Fubini ..... 343/813
3,747,114 A * 7/1973 Shyhalla ..... 343/795
3,995,277 A 11/1976 Olyphant, Jr. ..... 343/846
4,131,896 A * 12/1978 Miller ..... 343/815
4,173,019 A 10/1979 Williams ..... 343/700
4,514,734 A * 4/1985 Cermignani et al. ..... 343/815
5,485,167 A 1/1996 Wong et al. ..... 343/753

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

A wideband phased array antenna includes an array of dipole antenna elements on a flexible substrate. Each dipole antenna element has a medial feed portion and a pair of legs extending outwardly therefrom, and adjacent legs of adjacent dipole antenna elements have respective spaced apart end portions to provide increased capacitive coupling between the adjacent dipole antenna elements. Preferably, each leg has an elongated body portion, and an enlarged width end portion connected to an end of the elongated body portion. Thus, a phased array antenna with a wide frequency bandwith and a wide scan angle is obtained by utilizing tightly packed dipole antenna elements with large mutual capacitive coupling. Conventional approaches have sought to reduce mutual coupling between dipoles, but the present invention makes use of, and increases, mutual coupling between the closely spaced dipole antenna elements to prevent grating lobes and achieve the wide bandwidth.

40 Claims, 5 Drawing Sheets

WIDEBAND PHASED ARRAY ANTENNA AND ASSOCIATED METHODS

FIELD OF THE INVENTION

The present invention relates to the field of communications, and more particularly, to phased array antennas.

BACKGROUND OF THE INVENTION

Existing microwave antennas include a wide variety of configurations for various applications, such as satellite reception, remote broadcasting, or military communication. The desirable characteristics of low cost, light-weight, low profile and mass producibility are provided in general by printed circuit antennas. The simplest forms of printed circuit antennas are microstrip antennas wherein flat conductive elements are spaced from a single essentially continuous ground element by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, lightweight, low profile, and a low sidelobe.

The bandwidth and directivity capabilities of such antennas, however, can be limiting for certain applications. While the use of electromagnetically coupled microstrip patch pairs can increase bandwidth, obtaining this benefit presents significant design challenges, particularly where maintenance of a low profile and broad beamwidth is desirable. Also, the use of an array of microstrip patches can improve directivity by providing a predetermined scan angle. However, utilizing an array of microstrip patches presents a dilemma. The scan angle can be increased if the array elements are spaced closer together, but closer spacing can increase undesirable coupling between antenna elements thereby degrading performance.

Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwith of a phased array antenna with a wide scan angle is conventionally achieved by dividing the frequency range into multiple bands. This approach results in a considerable increase in the size and weight of the antenna while creating a Radio Frequency (RF) interface problem. Also, gimbals have been used to mechanically obtain the required scan angle. Again, this approach increases the size and weight of the antenna, and results in a slower response time.

Thus, there is a need for a lightweight phased array antenna with a wide frequency bandwidth and a wide scan angle, and that is conformally mountable to a surface.

SUMMARY OF THE INVENTION

In view of the foregoing background, it is therefore an object of the invention to provide a lightweight phased array antenna with a wide frequency bandwith and a wide scan angle, and that can be conformally mountable to a surface.

This and other objects, features and advantages in accordance with the present invention are provided by a wideband phased array antenna including an array of dipole antenna elements on a flexible substrate. Each dipole antenna element comprises a medial feed portion and a pair of legs extending outwardly therefrom, and adjacent legs of adjacent dipole antenna elements have respective spaced apart end portions to provide increased capacitive coupling between the adjacent dipole antenna elements. The spaced apart end portions have a predetermined shape and are relatively positioned to provide increased capacitive coupling between the adjacent dipole antenna elements. Preferably, the spaced apart end portions in adjacent legs comprise interdigitated portions, and each leg comprises an elongated body portion, an enlarged width end portion connected to an end of the elongated body portion, and a plurality of fingers, e.g. four, extending outwardly from said enlarged width end portion.

The wideband phased array antenna has a desired frequency range and the spacing between the end portions of adjacent legs is less than about one-half a wavelength of a highest desired frequency. Also, the array of dipole antenna elements may include first and second sets of orthogonal dipole antenna elements to provide dual polarization. A ground plane is preferably provided adjacent the array of dipole antenna elements and is spaced from the array of dipole antenna elements less than about one-half a wavelength of a highest desired frequency.

Preferably, each dipole antenna element comprises a printed conductive layer, and the array of dipole antenna elements are arranged at a density in a range of about 100 to 900 per square foot. The array of dipole antenna elements are sized and relatively positioned so that the wideband phased array antenna is operable over a frequency range of about 2 to 30 Ghz, and at a scan angle of about ±60 degrees. There may be at least one dielectric layer on the array of dipole antenna elements, and the flexible substrate may be supported on a rigid mounting member having a non-planar three-dimensional shape.

Features and advantages in accordance with the present invention are also provided by a method of making a wideband phased array antenna including forming an array of dipole antenna elements on a flexible substrate, where each dipole antenna element comprises a medial feed portion and a pair of legs extending outwardly therefrom. Forming the array of dipole antenna elements includes shaping and positioning respective spaced apart end portions of adjacent legs of adjacent dipole antenna elements to provide increased capacitive coupling between the adjacent dipole antenna elements. Shaping and positioning the respective spaced apart end portions preferably comprises forming interdigitated portions.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
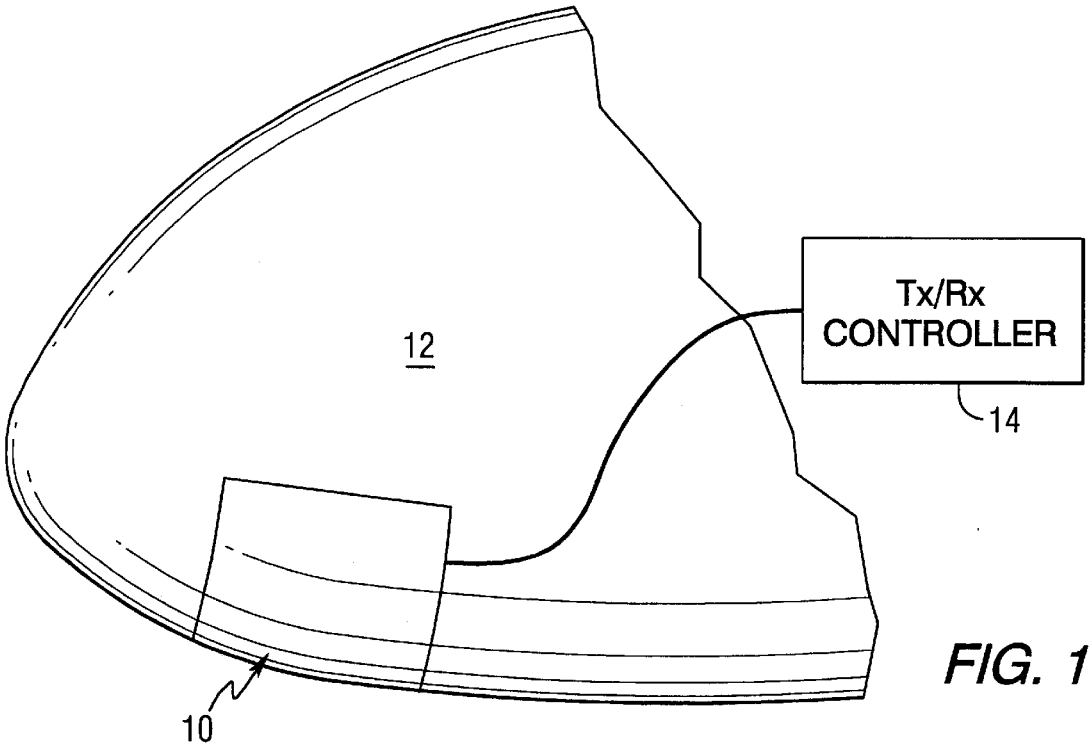
FIG. 1 is a schematic diagram illustrating the wideband phased array antenna of the present invention mounted on the nosecone of an aircraft, for example.
Figure 2:
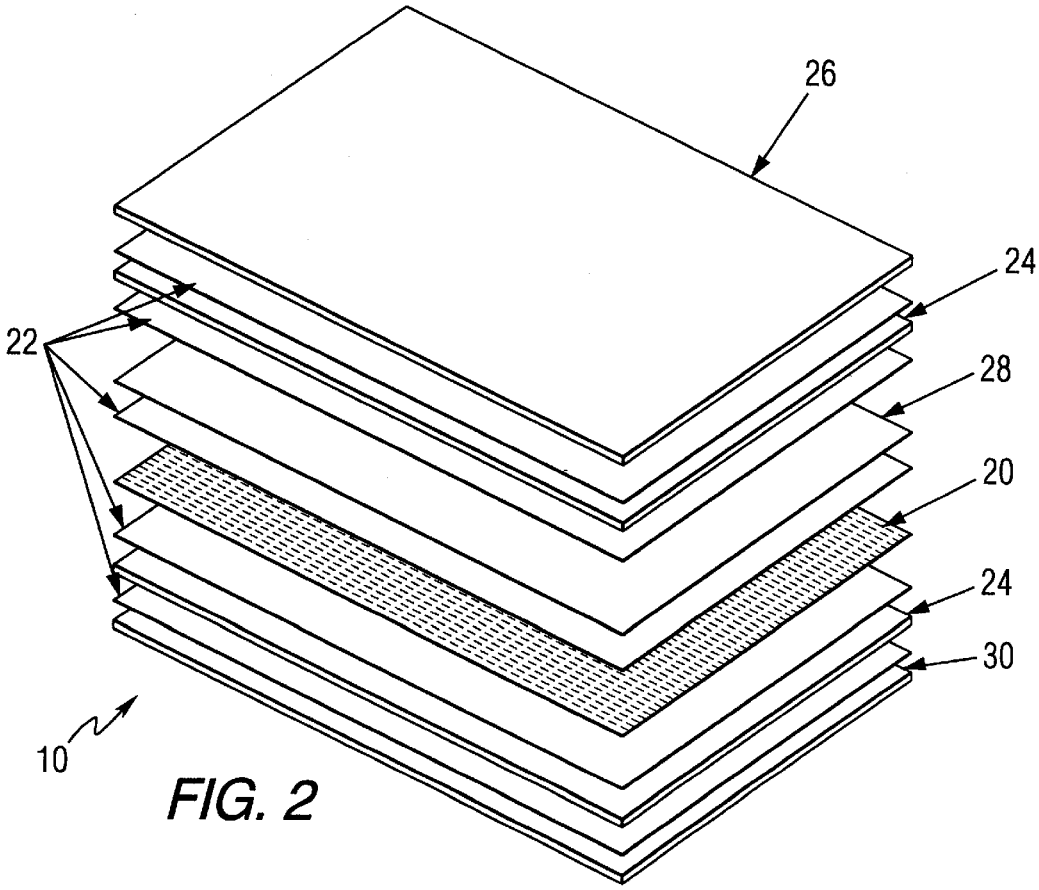
FIG. 2 is an exploded view of the wideband phased array antenna of FIG. 1.
Figure 3:
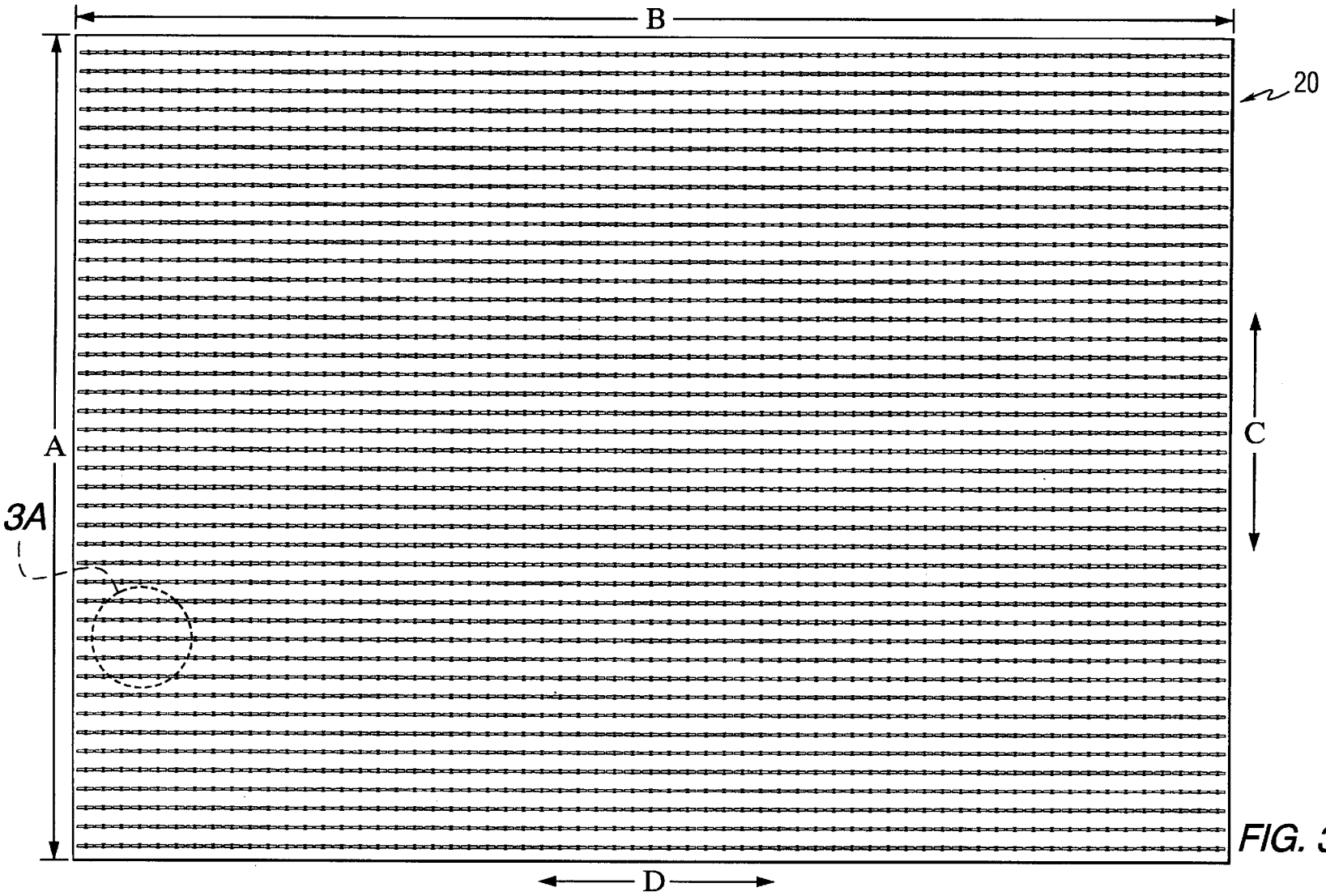
FIG. 3 is a schematic diagram of the printed conductive layer of the wideband phased array antenna of FIG. 1.
Figure 3A:
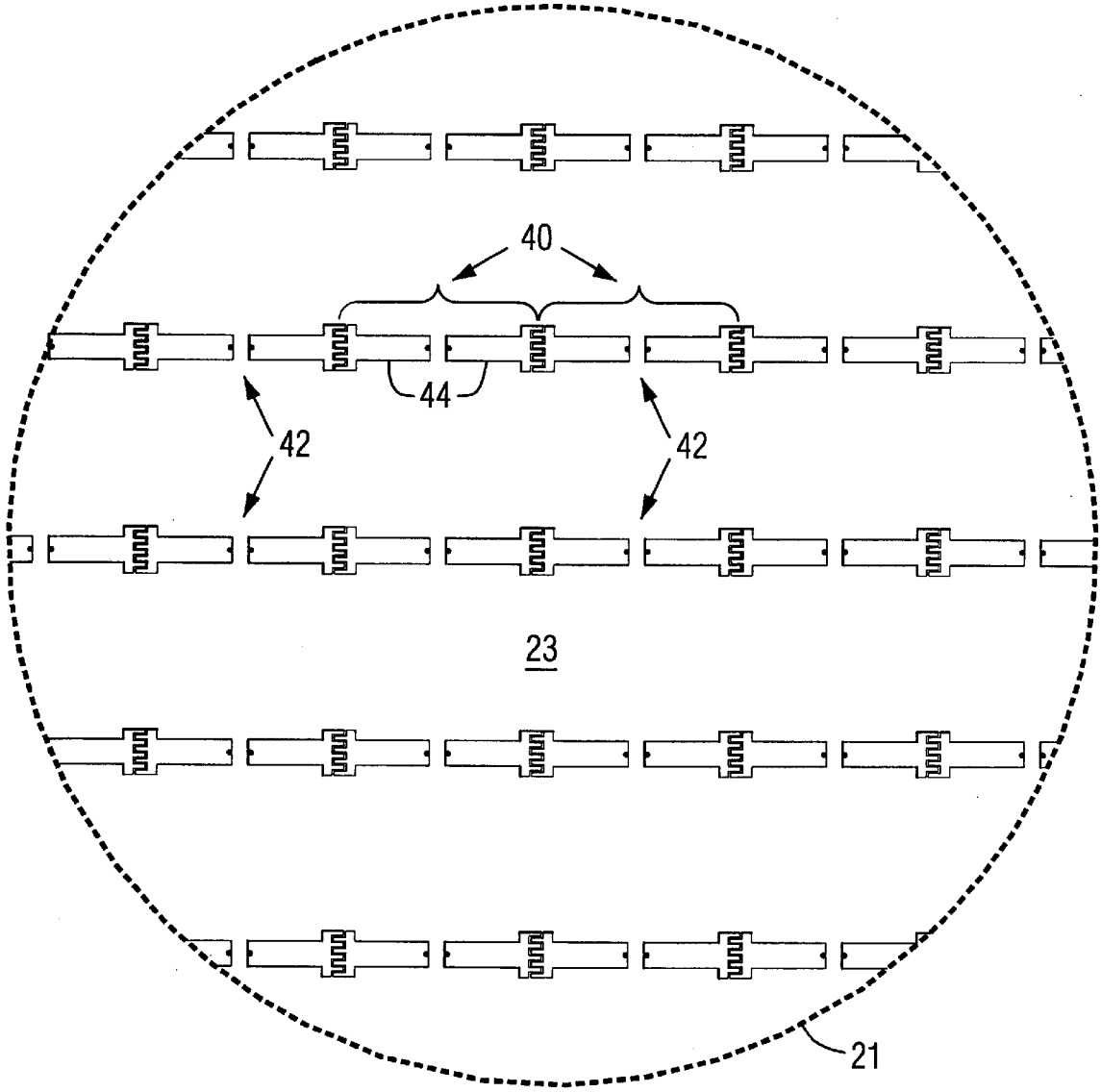
FIG. 3A is a greatly enlarged view of a portion of the array of FIG. 3.

Referring initially to FIGS. 1 and 2, a wideband phased array antenna 10 in accordance with the present invention will now be described. The antenna 10 may be mounted on the nosecone 12, or other rigid mounting member having a non-planar three-dimensional shape, of an aircraft or spacecraft, for example, and may also be connected to a transmission and reception controller 14 as would be appreciated by the skilled artisan.

The wideband phased array antenna 10 is preferably formed of a plurality of flexible layers as shown in FIG. 2. These layers include a dipole layer 20 or current sheet which is sandwiched between a ground plane 30 and a cap layer 28. Additionally, dielectric layers of foam 24 and an outer dielectric layer of foam 26 are provided. Respective adhesive layers 22 secure the dipole layer 20, ground plane 30, cap layer 28, and dielectric layers of foam 24, 26 together to form the flexible and conformal antenna 10. Of course other ways of securing the layers may also be used as would be appreciated by the skilled artisan. The dielectric layers 24, 26 may have tapered dielectric constants to improve the scan angle. For example, the dielectric layer 24 between the ground plane 30 and the dipole layer 20 may have a dielectric constant of 3.0, the dielectric layer 24 on the opposite side of the dipole layer 20 may have a dielectric constant of 1.7, and the outer dielectric layer 26 may have a dielectric constant of 1.2.

Referring now to FIGS. 3, 3A, 4A and 4B, a first embodiment of the dipole layer 20 will now be described. The dipole layer 20 is a printed conductive layer having an array of dipole antenna elements 40 on a flexible substrate 23, shown in greater detail in the enlarged view, FIG. 3A, of a portion 21 of the dipole layer 20. Each dipole antenna element 40 comprises a medial feed portion 42 and a pair of legs 44 extending outwardly therefrom. Respective feed lines would be connected to each feed portion 42 from the opposite side of the substrate 23. Adjacent legs 44 of adjacent dipole antenna elements 40 have respective spaced apart end portions 46 to provide increased capacitive coupling between the adjacent dipole antenna elements. The adjacent dipole antenna elements 40 have predetermined shapes and relative positioning to provide the increased capacitive coupling. For example, the capacitance between adjacent dipole antenna elements 40 is between about 0.016 and 0.636 picofarads (pF), and preferably between 0.159 and 0.239 pF.

Figure 4A:
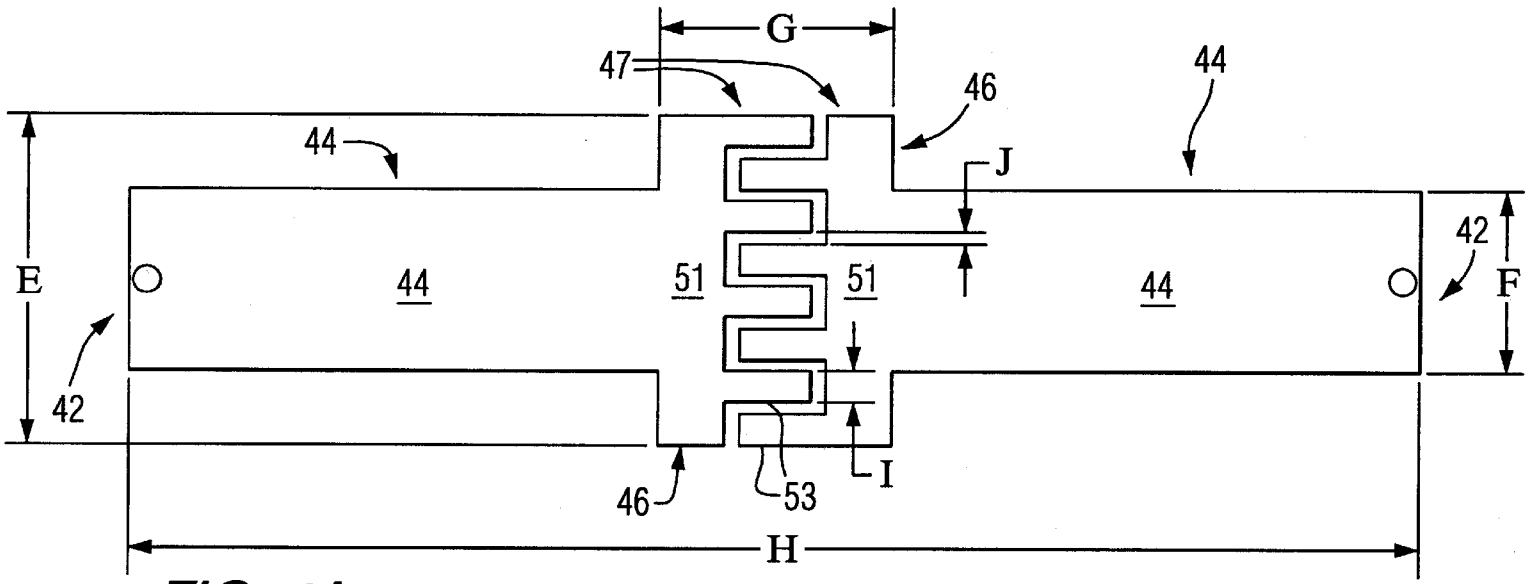
FIGS. 4A and 4B are enlarged schematic views of the spaced apart end portions of adjacent legs of adjacent dipole antenna elements as may be used in the wideband phased array antenna of FIG. 1.

Preferably, as shown in FIG. 4A, the spaced apart end portions 46 in adjacent legs 44 have overlapping or interdigitated portions 47, and each leg 44 comprises an elongated body portion 49, an enlarged width end portion 51 connected to an end of the elongated body portion, and a plurality of fingers 53, e.g. four, extending outwardly from the enlarged width end portion.

Figure 4B:
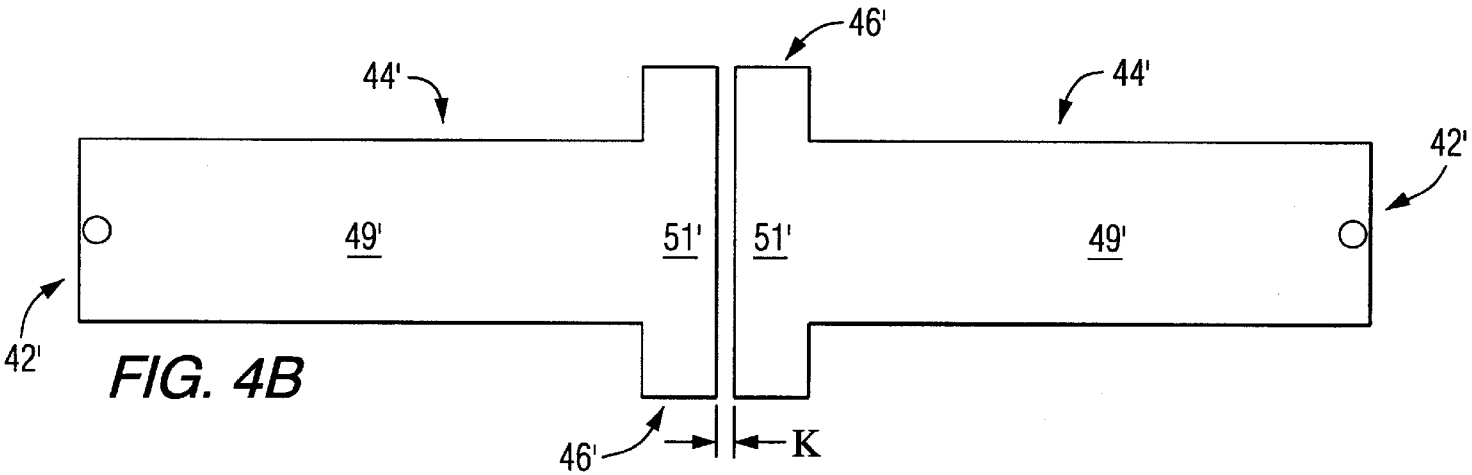

Alternatively, as shown in FIG. 4B, adjacent legs 44' of adjacent dipole antenna elements 40 may have respective spaced apart end portions 46' to provide increased capacitive coupling between the adjacent dipole antenna elements. In this embodiment, the spaced apart end portions 46' in adjacent legs 44' comprise enlarged width end portions 51' connected to an end of the elongated body portion 49' to provide the increased capacitive coupling between the adjacent dipole antenna elements. Here, for example, the distance K between the spaced apart end portions 46' is about 0.003 inches. Of course other arrangements which increase the capacitive coupling between the adjacent dipole antenna elements may also be possible.

Preferably, the array of dipole antenna elements 40 are arranged at a density in a range of about 100 to 900 per square foot. The array of dipole antenna elements 40 are sized and relatively positioned so that the wideband phased array antenna 10 is operable over a frequency range of about 2 to 30 Ghz, and at a scan angle of about ±60 degrees (low scan loss). Such an antenna 10 may also have a 10:1 or greater bandwidth, includes conformal surface mounting, while being relatively lightweight, and easy to manufacture at a low cost.

For example, FIG. 4A is a greatly enlarged view showing adjacent legs 44 of adjacent dipole antenna elements 40 having respective spaced apart end portions 46 to provide the increased capacitive coupling between the adjacent dipole antenna elements. In the example, the adjacent legs 44 and respective spaced apart end portions 46 may have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches. In the example (referring to FIG. 3), the dipole layer 20 may have the following dimensions: a width A of twelve inches and a height B of eighteen inches. In this example, the number C of dipole antenna elements 40 along the width A equals 43, and the number D of dipole antenna elements along the length B equals 65, resulting in an array of 2795 dipole antenna elements.

The wideband phased array antenna 10 has a desired frequency range, e.g. 2 GHz to 18 GHz, and the spacing between the end portions 46 of adjacent legs 44 is less than about one-half a wavelength of a highest desired frequency.

Figure 5A:
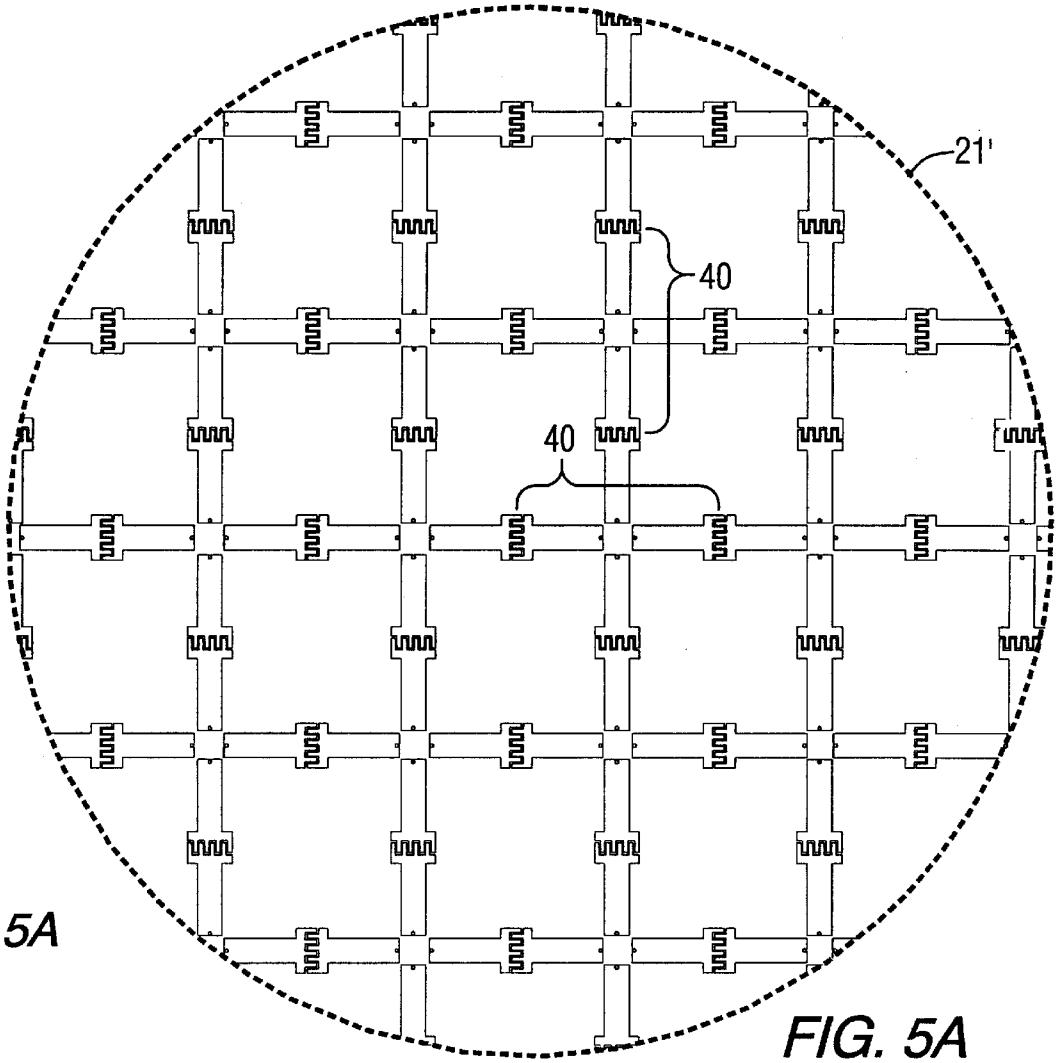
FIG. 5A is a greatly enlarged view of a portion of the array of FIG. 5.
Figure 5:
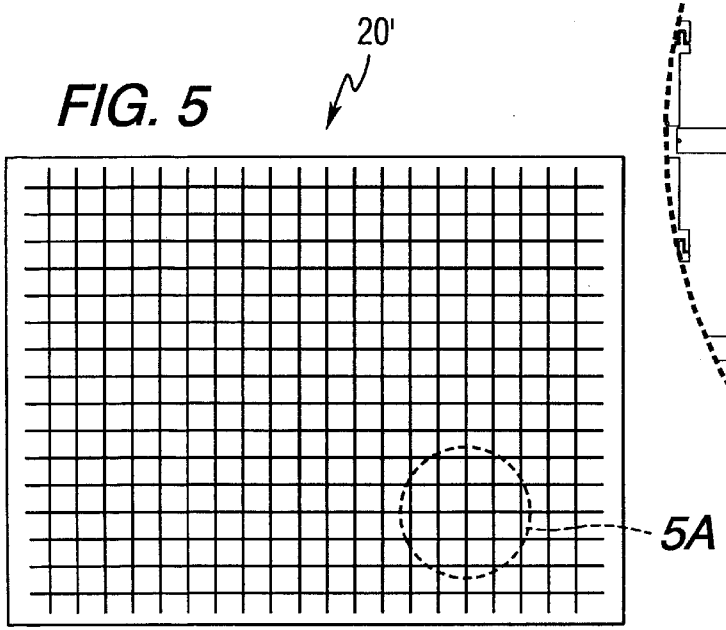
FIG. 5 is a schematic diagram of the printed conductive layer of the wideband phased array antenna of another embodiment of the present invention.
Figure 4A:
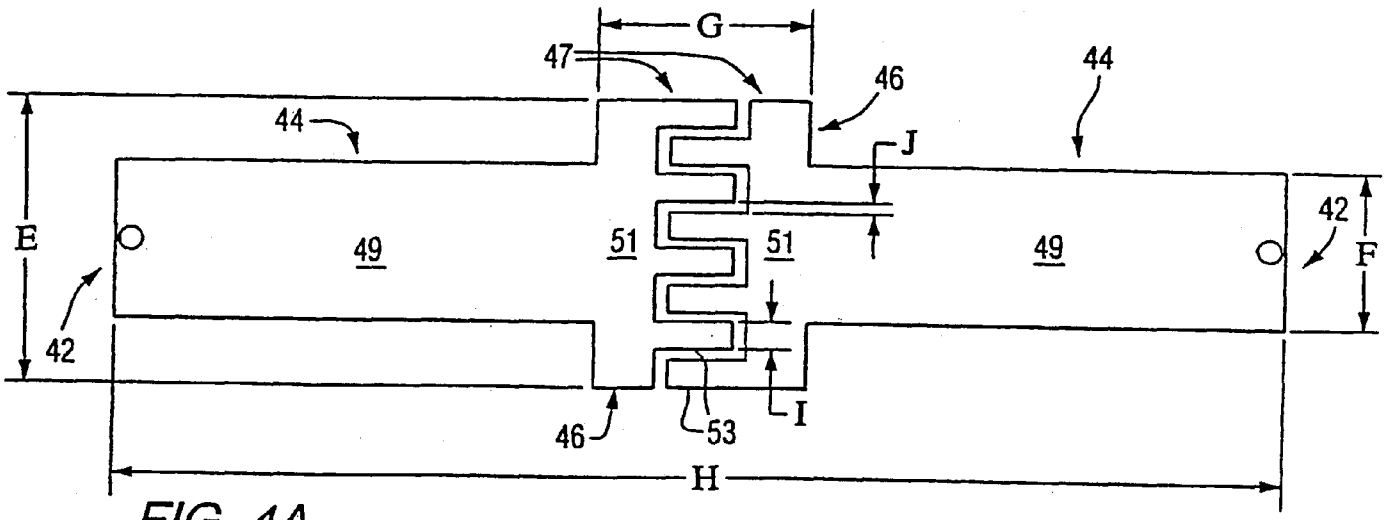
Figure 4B:
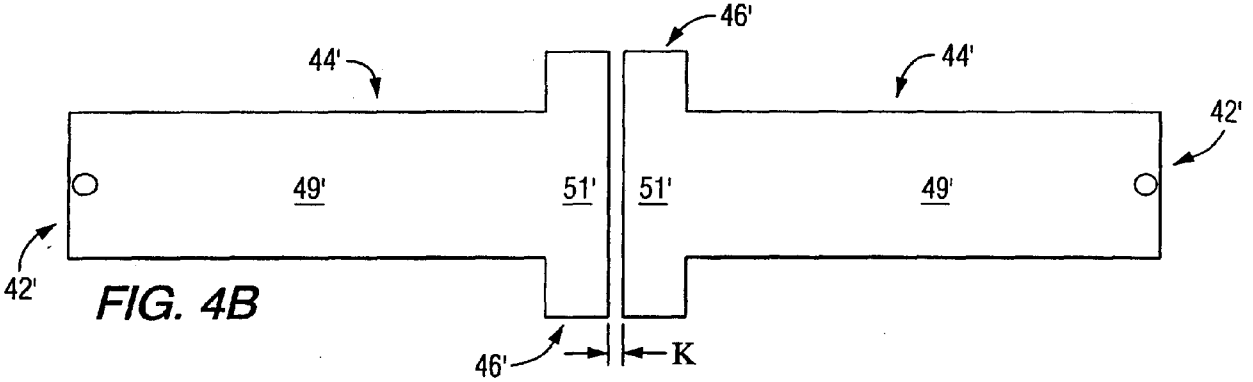

Referring to FIGS. 5 and 5A, another embodiment of the dipole layer 20' may include first and second sets of dipole antenna elements 40 which are orthogonal to each other to provide dual polarization, as would be appreciated by the skilled artisan. The first and second sets of dipole antenna elements 40 are shown in greater detail in the enlarged view, FIG. 5A, of a portion 21' of the dipole layer 20'.

A method aspect of the present invention includes making the wideband phased array antenna 10 by forming then array of dipole antenna elements 40 on the flexible substrate 23. This preferably includes printing and/or etching a conductive layer of dipole antenna elements 40 on the substrate 23. As shown in FIGS. 5 and 5A, first and second sets of dipole antenna elements 40 may be formed orthogonal to each other to provide dual polarization.

Again, each dipole antenna element 40 includes the medial feed portion 42 and the pair of legs 44 extending outwardly therefrom. Forming the array of dipole antenna elements 40 includes shaping and positioning respective spaced apart end portions 46 of adjacent legs 44 of adjacent dipole antenna elements to provide increased capacitive coupling between the adjacent dipole antenna elements. Shaping and positioning the respective spaced apart end portions 46 preferably includes forming interdigitated portions 47 (FIG. 4A) or enlarged width end portions 51' (FIG. 4B). A ground plane 30 is preferably formed adjacent the array of dipole antenna elements 40, and one or more dielectric layers 24, 26 are layered on both sides of the dipole layer 20 with adhesive layers 22 therebetween.

Forming the array of dipole antenna elements 40 may further include forming each leg 44 with an elongated body portion 49, an enlarged width end portion 51 connected to an end of the elongated body portion, and a plurality of fingers 53 extending outwardly from the enlarged width end portion. Again, the wideband phased array antenna 10 has a desired frequency range, and the spacing between the end portions 46 of adjacent legs 44 is less than about one-half a wavelength of a highest desired frequency. The ground plane 30 is spaced from the array of dipole antenna elements 40 less than about one-half a wavelength of the highest desired frequency.

As discussed above, the array of dipole antenna elements 40 are preferably sized and relatively positioned so that the wideband phased array antenna 10 is operable over a frequency range of about 2 to 30 GHz, and operable over a scan angle of about ±60 degrees. The method may also include mounting the antenna 10 on a rigid mounting member 12 having a non-planar three-dimensional shape, such as the nosecone 12 of an aircraft or spacecraft (FIG. 1).

Thus, a phased array antenna 10 with a wide frequency bandwith and a wide scan angle is obtained by utilizing tightly packed dipole antenna elements 40 with large mutual capacitive coupling. Conventional approaches have sought to reduce mutual coupling between dipoles, but the present invention makes use of, and increases, mutual coupling between the closely spaced dipole antenna elements to prevent grating lobes and achieve the wide bandwidth. The antenna 10 is scannable with a beam former and each antenna dipole element 40 has a wide beam width. The layout of the elements 40 could be adjusted on the flexible substrate 23 or printed circuit board, or the bean former may be used to adjust the path lengths of the elements to put them in phase.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wideband phased array antenna comprising:

a flexible substrate; and an array of dipole antenna elements on said flexible substrate, each dipole antenna element comprising a medial feed portion and a pair of legs extending outwardly therefrom, adjacent legs of adjacent dipole antenna elements including respective spaced apart end portions having predetermined shapes and relative positioning to provide increased capacitive coupling between the adjacent dipole antenna elements.

2. A wideband phased array antenna according to claim 1 wherein each leg comprises:

an elongated body portion; and an enlarged width end portion connected to an end of the elongated body portion.

3. A wideband phased array antenna according to claim 1 wherein the spaced apart end portions in adjacent legs comprise interdigitated portions.

4. A wideband phased array antenna according to claim 3 wherein each leg comprises an elongated body portion, an enlarged width end portion connected to an end of the elongated body portion, and a plurality of fingers extending outwardly from said enlarged width end portion.

5. A wideband phased array antenna according to claim 1 wherein the capacitive coupling between the adjacent dipole antenna elements is between about 0.159 and 0.239 picofarads.

6. A wideband phased array antenna according to claim 1 wherein the wideband phased array antenna has a desired frequency range; and wherein the spacing between the end portions of adjacent legs is less than about one-half a wavelength of a highest desired frequency.

7. A wideband phased array antenna according to claim 1 wherein said array of dipole antenna elements comprises first and second sets of orthogonal dipole antenna elements to provide dual polarization.

8. A wideband phased array antenna according to claim 1 further comprising a ground plane adjacent said array of dipole antenna elements.

9. A wideband phased array antenna according to claim 8 wherein the wideband phased array antenna has a desired frequency range; and wherein said ground plane is spaced from said array of dipole antenna elements less than about one-half a wavelength of a highest desired frequency.

10. A wideband phased array antenna according to claim 1 wherein each dipole antenna element comprises a printed conductive layer.

11. A wideband phased array antenna according to claim 1 said array of dipole antenna elements are arranged at a density in a range of about 100 to 900 per square foot.

12. A wideband phased array antenna according to claim 1 wherein said array of dipole antenna elements are sized and relatively positioned so that the wideband phased array antenna is operable over a frequency range of about 2 to 30 GHz.

13. A wideband phased array antenna according to claim 1 wherein said array of dipole antenna elements are sized and relatively positioned so that the wideband phased array antenna is operable over a scan angle of about ±60 degrees.

14. A wideband phased array antenna according to claim 1 further comprising at least one dielectric layer on said array of dipole antenna elements.

15. A wideband phased array antenna according to claim 1 further comprising a rigid mounting member having a non-planar three-dimensional shape supporting said flexible substrate.

16. A wideband phased array antenna comprising an array of dipole antenna elements each including a medial feed portion and a pair of legs extending outwardly therefrom, adjacent legs of adjacent dipole antenna elements having respective spaced apart interdigitated end portions to provide increased capacitive coupling between the adjacent dipole antenna elements.

17. A wideband phased array antenna according to claim 16 wherein each leg comprises an elongated body portion, an enlarged width end portion connected to an end of the elongated body portion, and a plurality of fingers extending outwardly from said enlarged width end portion.

18. A wideband phased array antenna according to claim 17 wherein the plurality of fingers comprises at least four fingers.

19. A wideband phased array antenna according to claim 16 wherein the wideband phased array antenna has a desired frequency range; and wherein the spacing between the end portions of adjacent legs is less than about one-half a wavelength of a highest desired frequency.

20. A wideband phased array antenna according to claim 16 wherein said array of dipole antenna elements comprises first and second sets of orthogonal dipole antenna elements to provide dual polarization.

21. A wideband phased array antenna according to claim 16 further comprising:

a substrate carrying said array of dipole antenna elements; and a ground plane adjacent said array of dipole antenna elements.

22. A wideband phased array antenna according to claim 21 wherein the wideband phased array antenna has a desired frequency range; and wherein said ground plane is spaced from said array of dipole antenna elements less than about one-half a wavelength of a highest desired frequency.

23. A wideband phased array antenna according to claim 16 wherein each dipole antenna element comprises a printed conductive layer.

24. A wideband phased array antenna according to claim 16 said array of dipole antenna elements are arranged at a density in a range of about 100 to 900 per square foot.

25. A wideband phased array antenna according to claim 16 wherein said array of dipole antenna elements are sized and relatively positioned so that the wideband phased array antenna is operable over a frequency range of about 2 to 30 GHz.

26. A wideband phased array antenna according to claim 16 wherein said array of dipole antenna elements are sized and relatively positioned so that the wideband phased array antenna is operable over a scan angle of about ±60 degrees.

27. A wideband phased array antenna according to claim 16 further comprising at least one dielectric layer on said array of dipole antenna elements.

28. A method of making a wideband phased array antenna comprising:

providing a flexible substrate; and forming an array of dipole antenna elements on the flexible substrate, each dipole antenna element comprising a medial feed portion and a pair of legs extending outwardly therefrom, wherein forming the array of dipole antenna elements includes shaping and positioning respective spaced apart end portions of adjacent legs of adjacent dipole antenna elements to provide increased capacitive coupling between the adjacent dipole antenna elements.

29. A method according to claim 28 wherein forming the array of dipole antenna elements comprises forming each leg with an elongated body portion, and an enlarged width end portion connected to an end of the elongated body portion.

30. A method according to claim 28 wherein shaping and positioning respective spaced apart end portions comprises forming interdigitated portions.

31. A method according to claim 30 wherein forming the array of dipole antenna elements comprises forming each leg with an elongated body portion, an enlarged width end portion connected to an end of the elongated body portion, and a plurality of fingers extending outwardly from said enlarged width end portion.

32. A method according to claim 28 wherein the wideband phased array antenna has a desired frequency range; and wherein the spacing between the end portions of adjacent legs is less than about one-half a wavelength of a highest desired frequency.

33. A method according to claim 28 wherein forming the array of dipole antenna elements comprises forming first and second sets of orthogonal dipole antenna elements to provide dual polarization.

34. A method according to claim 28 further comprising forming a ground plane adjacent the array of dipole antenna elements.

35. A method according to claim 34 wherein the wideband phased array antenna has a desired frequency range; and wherein the ground plane is spaced from the array of dipole antenna elements less than about one-half a wavelength of a highest desired frequency.

36. A method according to claim 28 wherein forming the array of dipole antenna elements comprises printing a conductive layer to form each dipole antenna element.

37. A method according to claim 28 wherein the array of dipole antenna elements are sized and relatively positioned so that the wideband phased array antenna is operable over a frequency range of about 2 to 30 GHz.

38. A method according to claim 28 wherein the array of dipole antenna elements are sized and relatively positioned so that the wideband phased array antenna is operable over a scan angle of about ±60 degrees.

39. A method according to claim 28 further comprising forming at least one dielectric layer on the array of dipole antenna elements.

40. A method according to claim 28 further comprising mounting the flexible substrate carrying the array of dipole antenna elements on a rigid mounting member having a non-planar three-dimensional shape.

* * * * *

UNITED STATES PATENT AND TRADEMARK OFFICE

CERTIFICATE OF CORRECTION

PATENT NO. : 6,512,487 B1 
DATED : January 28, 2003
INVENTOR(S) : Robert Charles Taylor, Benedikt A. Munk and Timothy Earl Durham It is certified that error appears in the above-identified patent and that said Letters Patent is hereby corrected as shown below:

Title page,
Item [57], ABSTRACT,
Line 11, delete "bandwith" insert -- bandwidth --

Delete drawing sheet 4, figure 4A, and substitute therefor the attached drawing sheet 4, figure 4A, as shown on attached sheet.

Column 1,
Lines 48 and 64, delete "bandwith" insert -- bandwidth --

Column 4,
Line 58, delete "then array" insert -- the array --

Column 5,
Line 33, delete "bandwith" insert -- bandwidth --
Line 43, delete "bean" insert -- beam --

Column 6,
Line 35, delete "1 said" insert -- 1 wherein said --

Column 7,
Line 25, delete "16 said" insert -- 16 wherein said --

Signed and Sealed this

Nineteenth Day of August, 2003

JAMES E. ROGAN
*Director of the United States Patent and Trademark Office*